US005642684A

United States Patent [19]

Aker

[11] Patent Number: 5,642,684

[45] Date of Patent: Jul. 1, 1997

[54] THRUST DIRECTOR UNIT FOR A MARINE VESSEL

[75] Inventor: Charles M. Aker, Lake Forest, Calif.

[73] Assignee: Omnithruster Inc., Orange, Calif.

[21] Appl. No.: 664,525

[22] Filed: Jun. 17, 1996

[51] Int. Cl.[6] ..... B63H 25/46

[52] U.S. Cl. ..... 114/151; 440/43

[58] Field of Search ..... 440/38, 40, 43; 60/221, 222; 114/151

[56] References Cited

U.S. PATENT DOCUMENTS

| | | | |
|---|---|---|---|
| 368,678 | 8/1887 | McDougall | 440/43 |
| 1,344,518 | 6/1920 | Rees | 440/43 |
| 4,056,073 | 11/1977 | Dashew et al. . | |
| 4,214,544 | 7/1980 | Dashew et al. . | |
| 4,315,476 | 2/1982 | Van Der Tak | 114/151 |
| 4,423,696 | 1/1984 | Aker . | |
| 4,455,960 | 6/1984 | Aker . | |
| 4,522,141 | 6/1985 | Aker . | |
| 4,543,900 | 10/1985 | Aker . | |
| 5,289,793 | 3/1994 | Aker . | |

*Primary Examiner*—Edwin L. Swinehart

*Attorney, Agent, or Firm*—Kelly Bauersfeld, Lowry & Kelley

[57] ABSTRACT

An improved thrust director unit is provided for discharging a directionally adjustable water jet flow from the hull of a marine vessel to generate a thrust reaction force for close-quarter maneuvering and/or propulsion of the vessel. The unit comprises a thruster housing having an outlet through which the jet flow is discharged, wherein the outlet is defined by diverging fore and aft walls to permit angularly forward or rearward jet flow discharge for vessel propulsion. At least two deflector vanes are movable together within the housing outlet and cooperate therewith to define a directionally adjustable discharge flow path for selective jet flow discharge in a sideward direction to produce a sideward thrust, or in a forwardly or rearwardly angled direction to respectively produce a reverse or forward propulsion thrust. In the sideward thrust position, the discharge flow path has a nondiverging cross section and is isolated from the diverging fore-aft walls of the housing outlet.

15 Claims, 4 Drawing Sheets

FIG. 4
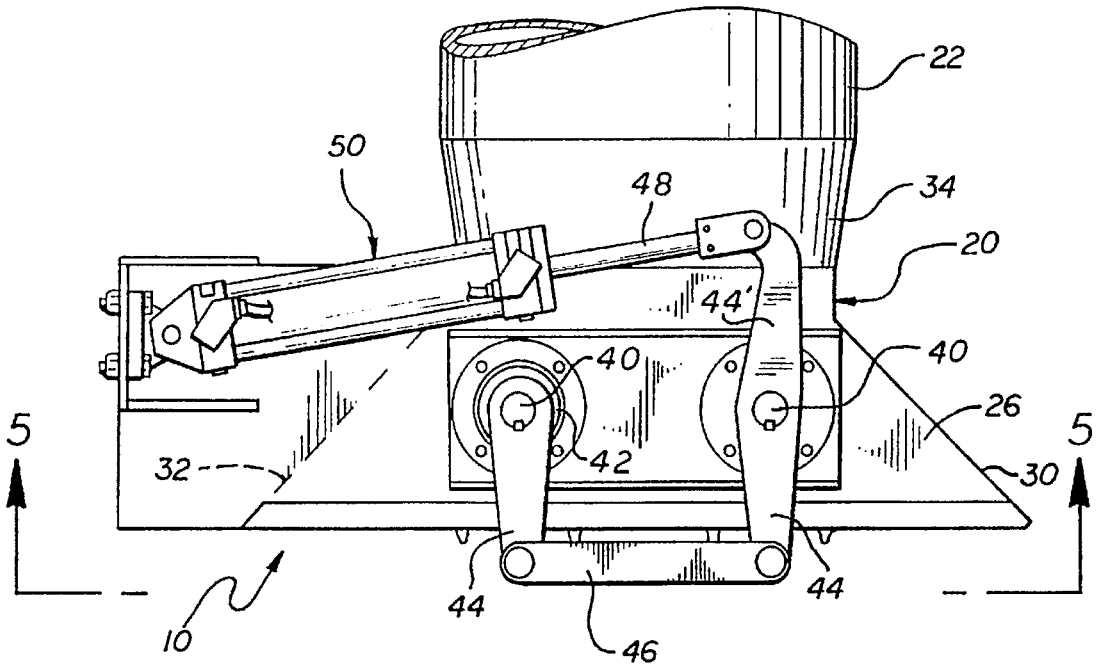
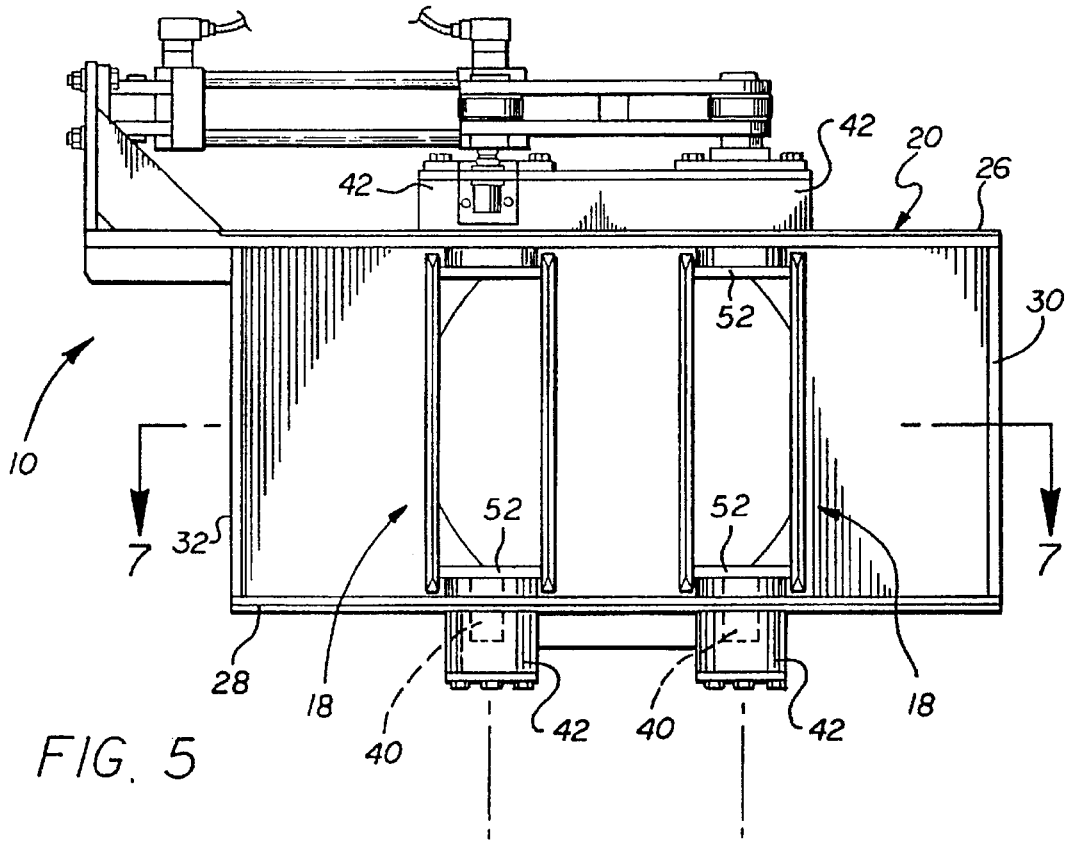
FIG. 5

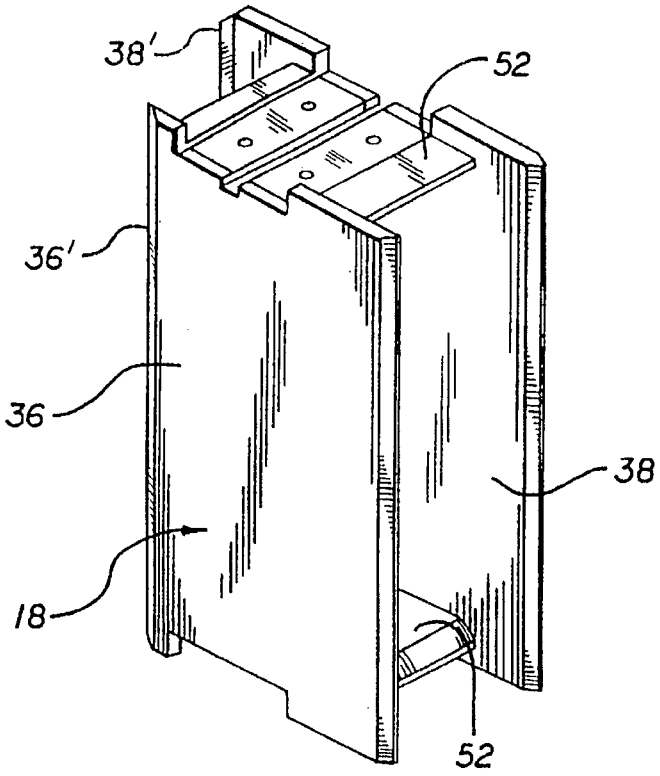
FIG. 6
FIG. 7
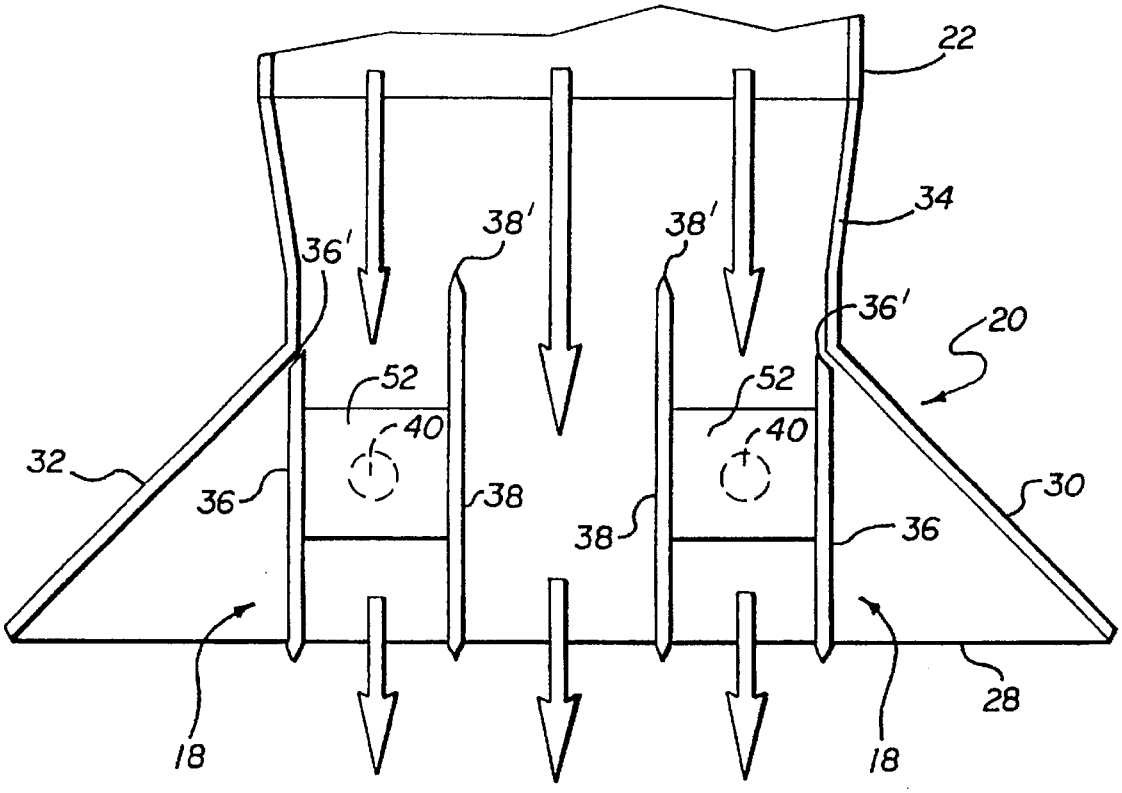

FIG. 8
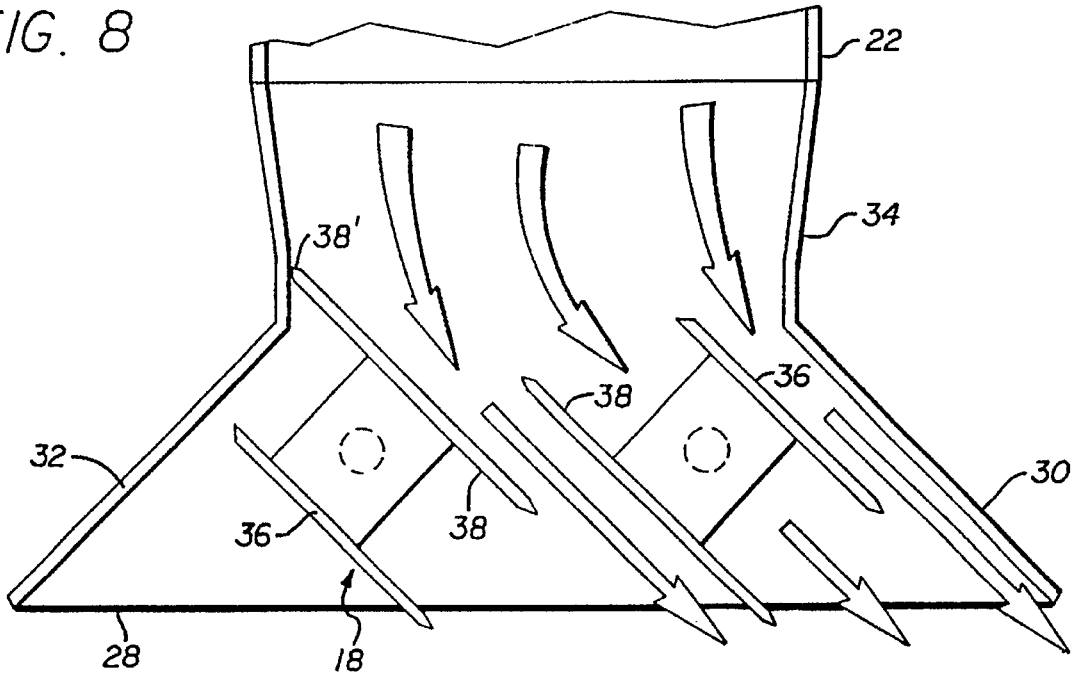
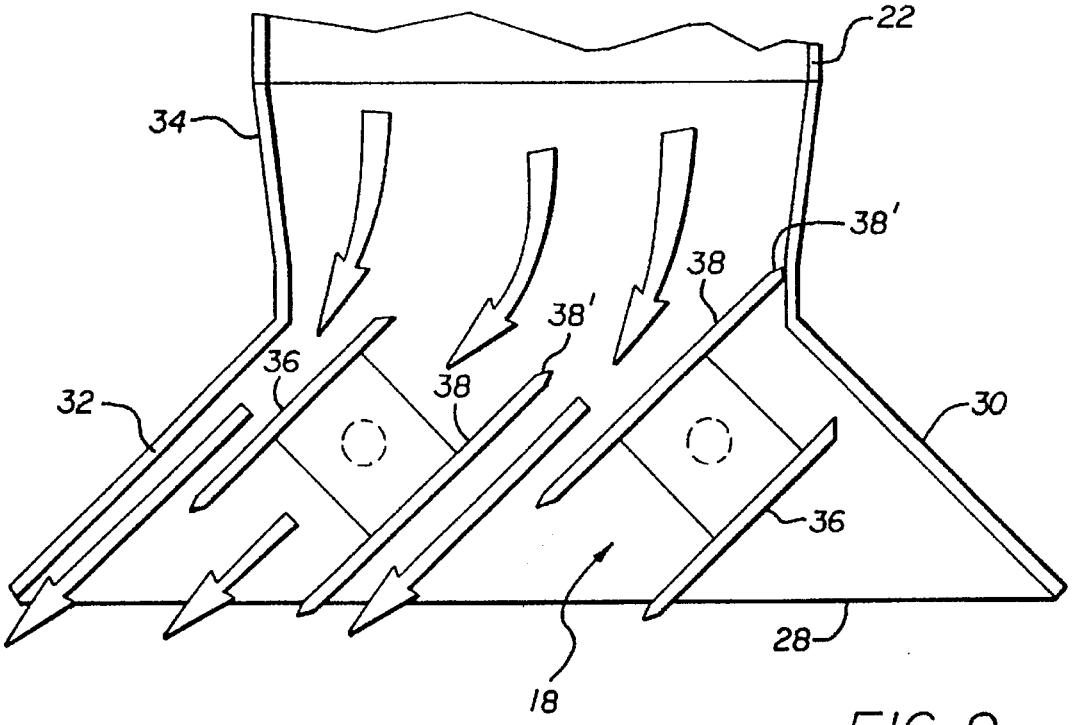
FIG. 9

THRUST DIRECTOR UNIT FOR A MARINE VESSEL

BACKGROUND OF THE INVENTION

This invention relates generally to thruster systems used for maneuvering a marine vessel. More specifically, this invention relates to an improved thrust director unit for use in a thruster system, to achieve energy-efficient generation of a directionally adjustable water jet flow used to maneuver and/or propel the marine vessel.

Boat thruster systems are generally known in the art for use in close-quarter maneuvering of a marine vessel. Such thruster systems are designed to generate a flow of water discharged below the water line from one side of a boat hull, resulting in a substantial hydraulic reaction force applied to the vessel for improved close-quarter maneuvering. In one traditional form, the thruster system comprises a relative large diameter propeller mounted within a correspondingly sized transverse opening or tunnel formed in a boat hull, wherein the propeller is adapted to generate a substantial mass flow of water directed to one side of the vessel in accordance with the direction of propeller rotation. While so-called tunnel thrusters of this type provide significant advantages in close-quarter vessel maneuvering, especially upon approach to or departure from a dock, the tunnel thruster system occupies a large volumetric space within the hull of the vessel. Moreover, large openings must be formed in the vessel's hull, usually in a dry dock environment, to accommodate installation of the requisite large diameter flow tunnel. As a result, tunnel thruster systems exhibit significant disadvantages with respect to system size and installation costs.

In recent years, alternative and comparatively more compact thruster systems have been designed wherein a high capacity water pump delivers water for discharge as a high velocity flow jet or jets through relatively small nozzles mounted at opposite sides of the vessel's hull. See, for example, U.S. Pat. Nos. 4,056,073; 4,214,544; 4,455,960; and 5,289,793. In these thruster systems, the pump draws in water through an open intake formed in the hull, and the water is delivered through a diffuser and directionally controlled vanes for discharge flow through one or more of the hull nozzles, resulting in an hydraulic reaction force which is effective to assist in vessel maneuvering. Thrust director units having adjustable vanes are often employed at the discharge nozzles for directionally adjusting the water jet flow in a sideward direction to generate a sideward thrust, or in a forwardly or rearwardly angled direction to respectively produce a reverse or forward propulsion thrust. In this regard, such thrust director units have typically included nozzle housings formed with diverging fore and aft walls to accommodate directional jet flow adjustment through a range of forwardly angled to rearwardly angled directions. Such nozzle housing geometries, of diverging configuration, have thereby tended to permit the discharged jet flow to diverge and diffuse such that there is substantial energy inefficiency particularly when vanes are set in a sideward thrust position.

The present invention provides a significant improvement upon thrust director units used in marine thruster systems, by providing a nozzle housing geometry of diverging shape to accommodate adjustable direction discharge of the water jet flow, but wherein deflector vanes cooperate with the nozzle housing to define a discharge flow path of nondiverging cross sectional shape.

SUMMARY OF THE INVENTION

In accordance with the invention, an improved thrust director unit is provided for use in a thruster system in a marine vessel. The thrust director unit discharges a water jet flow in a selectively adjustable direction from the side of the hull of a marine vessel, below the water line, to generate a thrust reaction force for close-quarter maneuvering and/or vessel propulsion. The thrust director unit comprises a relatively compact thruster or nozzle housing with a housing outlet defined by diverging fore and aft walls, in combination with at least two deflector vanes mounted within said housing outlet and movable together to define a directionally oriented discharge flow path. The cross sectional flow area of this discharge flow path is nondiverging in shape, particularly when the deflector vanes are oriented for discharging the water jet flow in a sideward direction substantially normal to a centerline of the marine vessel.

The thrust director unit is adapted for use in combination with a high capacity main pump, such as described in U.S. Pat. No. 5,289,793 which is incorporated by reference herein. Moreover, in the preferred configuration, the improved thrust director unit is provided in a pair of units mounted on opposite sides of the hull of a marine vessel with each thrust director unit being adapted to receive a high mass flow of water from the main pump for outward discharge from the vessel hull at a subsurface location, resulting in a reaction thrust force that can be used to maneuver the marine vessel.

In general terms, each thrust director unit includes the thruster housing having an inlet for receiving a water flow discharged through an associated flow conduit by the main pump. The deflector vanes associated with each thrust director unit are movable together to a sideward thrust position to produce a sideward thrust force, or in a forwardly or rearwardly angled position to respectively produce a reverse or forward drive thrust. In the sideward thrust position, appropriate flow control members associated with the main pump are typically operated to deliver the water jet flow to one, but not both of the thrust director units. In the forward or reverse drive positions, these flow control members are normally operated to deliver the water jet flow from the main pump to both thrust director units.

The deflector vanes for each thrust director unit are pivotally mounted in parallel relation to extend vertically across the housing outlet, and actuator means are provided for pivoting the deflector vanes together. In a forwardly angled position, the deflector vanes are oriented generally in parallel with the fore wall of the housing outlet and cooperate therewith to define a discharge flow path of nondiverging cross sectional shape for discharging the water jet flow angularly forwardly, to achieve reverse propulsive thrust. In a rearwardly angled position, the deflector vanes are oriented in parallel with the aft wall of the housing outlet and cooperate therewith to define a discharge flow path of nondiverging cross sectional shape for discharging the water jet flow angularly rearwardly to achieve a forward propulsive thrust.

In a sideward thrust position, with the deflector vanes oriented generally perpendicular to the vessel centerline, the deflector vanes cooperate with the housing outlet to define a discharge flow path of nondiverging shape, and in isolation to the diverging fore and aft walls of the housing outlet. With this geometry, energy losses associated with diverging nozzle housing structures are avoided.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 4 is an enlarged fragmented top plan view of one of the thrust director units, corresponding generally with the encircled region 4 of FIG. 1;

FIG. 5 is an outboard side elevation view of the thrust director unit, taken generally on the line 5—5 of FIG. 4;

FIG. 6 is an enlarged perspective view illustrating one preferred form of a deflector vane for use in the invention;

FIG. 7 is a horizontal sectional view taken generally on the line 7—7 of FIG. 5, and depicting the thrust director unit is a sideward thrust position;

FIG. 8 is a horizontal sectional view similar to FIG. 7, but depicting the thrust director unit in a rearward thrust position; and FIG. 9 is a horizontal sectional view similar to FIGS. 7 and 8, but depicting the thrust director unit in a forward thrust position.

DETAILED DESCRIPTION OF THE PREFERRED EMBODIMENT

Figure 1:
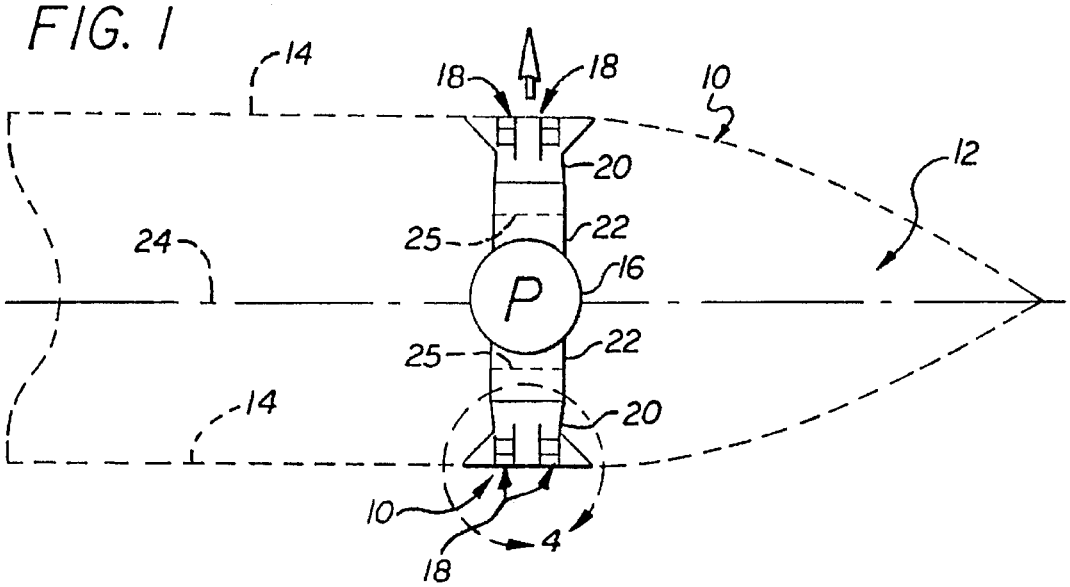
FIG. 1 is a schematic diagram illustrating a marine vessel equipped with a thruster system having a pair of the improved thrust director units embodying the novel features of the invention, and depicting the thrust director units in a sideward thrust position.
Figure 2:
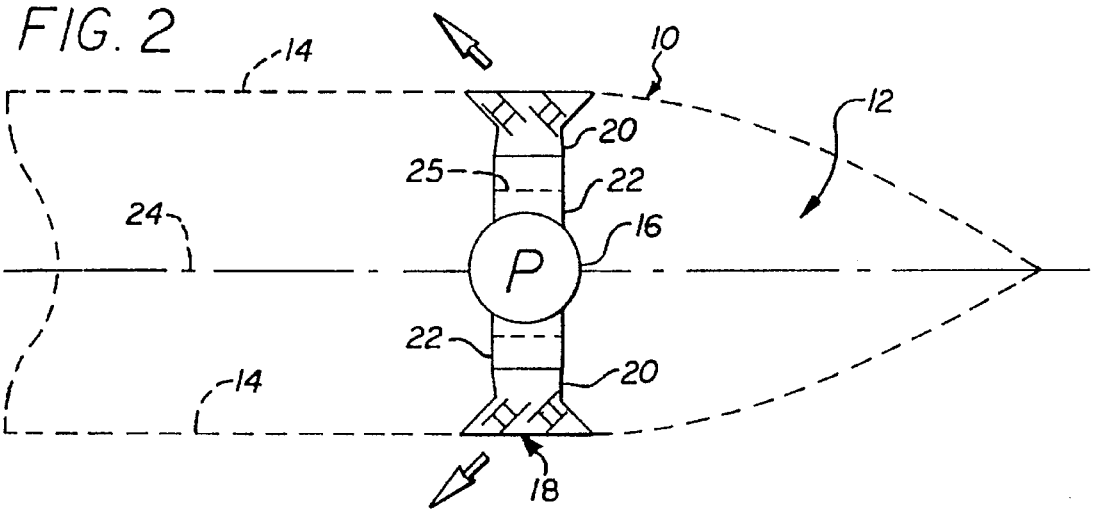
FIG. 2 is a schematic diagram similar to FIG. 1, but depicting the pair of thrust director units in a forward thrust position.
Figure 3:
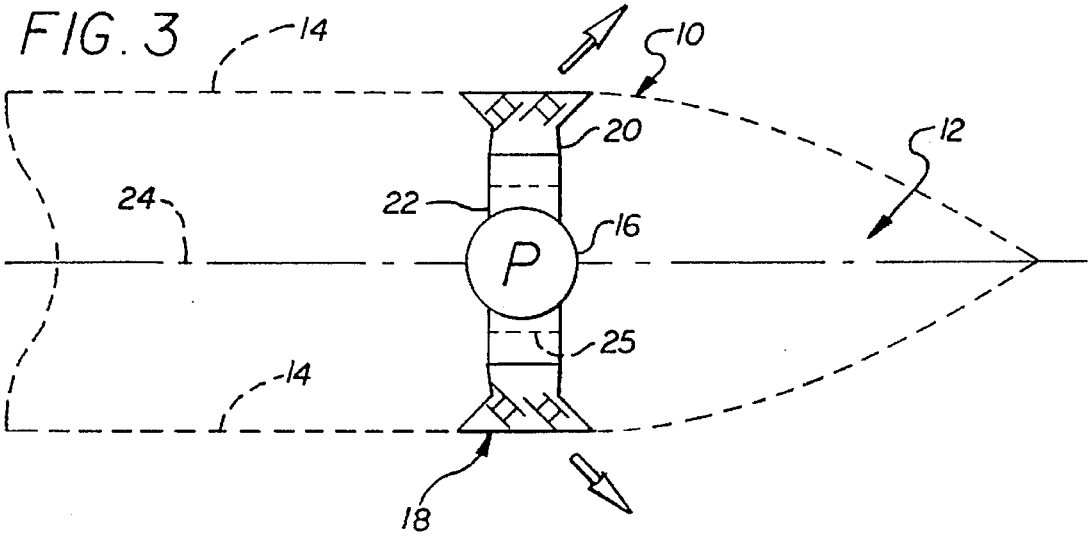
FIG. 3 is a schematic diagram similar to FIGS. 1 and 2, but depicting the pair of thrust director units in a rearward thrust position.

As shown in the exemplary drawings, an improved thrust director unit referred to generally by the reference numeral 10 is provided for close quarter maneuvering and/or forward or rearward propulsion of a marine vessel 12. FIGS. 1–3 illustrate a pair of the thrust director units 10 mounted within the hull 14 of the marine vessel 12, at opposite sides of the hull 14. The thrust director units 10 are adapted to receive a high mass flow of water from a high capacity main pump 16, of the type shown and described in U.S. Pat. No. 5,289,793, with adjustable deflector vanes 18 within each thrust director unit 10 adjustably discharging the water flow at a selected directional orientation. In each position of adjustment, the deflector vanes 18 cooperate with a thrust director housing 20 to define a water jet discharge flow path of nondiverging geometry.

The thrust director unit 10 of the present invention is particularly designed for use in a marine thruster system of the type shown and described in U.S. Pat. No. 5,289,793, which is incorporated by reference herein. Such thruster system includes the main pump 16 mounted typically within the vessel 12 at a generally centered position and designed to produce a high mass flow of water which can be selectively discharged from the vessel hull 14 at a subsurface location to produce an hydraulic reaction force for vessel maneuvering. The main pump 16 normally draws in water through an intake port (not shown) at the bottom of the vessel hull 14, and discharges the high mass flow of water through a pair of laterally directed flow conduits 22 to the pair of thrust director units 10 at the opposite sides of the vessel hull 14. As shown schematically in FIGS. 2 and 3, the deflector vanes 18 within the thrust direction units 10 can be oriented to discharge the water in a rearwardly angled direction (FIG. 2) to generate forward propulsive thrust, or to discharge the water in a forwardly angled direction (FIG. 3) to generate a reverse propulsive thrust. Alternatively, the deflector vanes 18 can be oriented to discharge the water in a sideward direction (FIG. 1), substantially normal to a centerline 24 of the vessel hull 14, to produce a sideward thrust for close quarter maneuvering and the like. In the sideward thrust configuration, appropriate flow control members 25 associated with the main pump 16 are normally operated to deliver the pump outflow to one, but not both, of the thrust director units 10.

FIGS. 4–6 illustrate one of the thrust director units 10 in more detail, wherein it will be understood that the two units 10 are identical in construction and operation with appropriate mirror image adaptations to accommodate mounting at opposite sides of the vessel hull 14. As shown, each thrust director unit 10 comprises the compact housing 20 defined by generally horizontal and parallel top and bottom walls 26 and 28 interconnected by outwardly diverging fore and aft walls 30 and 32. The sets of housing walls 26, 28, 30 and 32 form an open flow passage of diverging geometry in a fore-aft plane, with an outboard margin of the housing walls terminating generally at the hull 14 of the marine vessel 12. An inboard margin of the housing walls are joined to a cylindrical conduit segment 34 coupled to the downstream end of the associated flow conduit 22 through which the high mass water flow is provided from the main pump 16.

The deflector vanes 18 are mounted within the open flow passage defined by the housing walls 26, 28, 30, and 32. Each thrust director unit 10 is provided with at least two of the deflector vanes 18, with a preferred arrangement wherein each deflector vane 18 is formed by an interconnected pair of vane blades 36 and 38 to be described in more detail. As shown in the accompanying drawings, the deflector vanes 18 are mounted in vertically extending, parallel relation to project vertically through the open flow passage, terminating at their upper and lower ends in spindles 40 (FIGS. 4 and 5) which are supported in turn by appropriate bearings 42 located respectively above and below the top and bottom walls of the housing 20. The upper ends of the spindles 40 are coupled to a pair of crank links 44 which are interconnected for concurrent drive motion by a connector link 46. One of the crank links 44 includes an extension segment 44' coupled to the end of a drive ram 48 extending from an hydraulic cylinder unit 50.

The hydraulic cylinder unit 50 and the associated ram 48 and related links comprise an actuator means for adjustably orienting the angular setting of the deflector vanes 18 within the housing 20. More specifically, the hydraulic cylinder unit 50 is operated to extend or retract the drive ram 48 in a manner causing rotation of the two deflector vanes 18 together through a common angular increment. Accordingly, the deflector vanes 18 can be rotatably set in a sideward thrust position (FIGS. 1 and 7) to discharge the water jet flow in a sideward direction substantially normal to the hull centerline 24, or to discharge the water jet flow angularly rearwardly (FIGS. 2 and 9) or forwardly (FIGS. 3 and 8) to respectively produce a forward or reverse drive thrust.

In accordance with a primary aspect of the invention, the deflector vanes 18 cooperate with the walls of the thruster housing 20 to provide efficient discharge of the water jet flow substantially without energy-robbing divergence of the water flow discharged from the side of the hull 14. More particularly, the deflector vanes 18 cooperate with the housing walls to define an actual discharge flow path of substantially nondiverging cross sectional shape in each of the sideward, forward and rearward thrust positions. This nondiverging flow path is achieved by forming the deflector vanes 18 so that the upstream edges thereof align with and substantially abut or engage the housing fore and/or aft walls 30, 32 of the thruster housing 20 to prevent significant water flow along an undesired diverging pathway.

That is, in the sideward thrust position (FIGS. 1 and 7), the deflector vanes 18 cooperate with the upper and lower housing walls 26, 28 to substantially isolate the fore and aft walls 30, 32 from the discharge flow path. Similarly, in the forward thrust position, the deflector vanes 18 substantially isolate the discharge flow path from the fore wall 30, whereas the aft wall 32 is substantially isolated from the flow path when the deflector vanes 18 are in the rearward thrust position.

The preferred deflector vane geometry comprises a twin-bladed construction as shown best in FIG. 6. As shown, a pair of upper and lower struts 52 are interconnected between the pair of individual vane blades 36 and 38, wherein the struts 50 are designed for connection to the spindles 40. The two vane blades 36 and 38 have downstream edges which terminate in a common plane disposed at or near the outboard margin of the thruster housing 20 when the vanes 18 are in the sideward thrust position. However, the vane blade 36 disposed closer to the associated diverging fore or aft wall 30, 32 has an upstream edge 36' which terminates upstream relative to the upstream edge 38' of the associated vane blade 38. Accordingly, the upstream edge 38' of the vane blade 38 of each deflector vane 18 projects toward the inlet conduit segment 34, relative to the companion vane blade 36.

In the sideward thrust position, as shown best in FIG. 7, the deflector vanes 18 are oriented with the sets of vane blades 36, 38 generally perpendicular to the centerline 24 of the hull 14. In this position, the shorter vane blades 36 for the deflector vanes 18 have their upstream edges 36' located in close and/or abutting relation to the upstream ends of the fore and aft walls 30, 32. The vane blades 36 thus isolate the diverging walls 30, 32 from the discharge flow path whereby a nondiverging discharge flow path is cooperatively defined by the deflector vanes 18 in combination with the top and bottom housing walls 26, 28.

In a forward thrust position, as shown in FIG. 9, the deflector vanes 18 are rotated to redirect the discharge water flow angularly rearwardly. In this position, the vane blades 36, 38 are disposed generally in parallel to the aft housing wall 32, with the upstream edge 38' of the vane blade 38 of the forward vane set being engaged with the housing 20 at or near the upstream end of the fore wall 30. Thus, in this configuration, discharge water flow is prevented along the fore wall 30, and the entire water flow is directed angularly rearwardly through a flow path of nondiverging shape defined by the vane sets and along the aft wall 32.

Similarly, in the rearward thrust position as shown in FIG. 8, the deflector vanes 18 are rotated to redirect the discharge water flow angularly forwardly. The vane blades 36, 38 are disposed generally parallel to the fore wall 30, with the upstream edge 38' of the vane blade 38 of the rearward vane set being engaged with the housing 20 at or near the upstream end of the aft wall 32. Accordingly, in this position, the discharge water flow is prevented along the aft wall 32, and the water flow is directed angularly forwardly through a nondiverging flow path defined by the vane sets and along the fore wall 30.

The thrust director unit 10 thus provides a discharge flow path of nondiverging geometry for each of the three primary positions of directional vane adjustment. As a result, divergence of the discharged jet flow is prevented until the jet flow is delivered to the body of water surrounding the vessel hull, so that maximum reaction thrust forces are generated for vessel maneuvering.

A variety of modifications and improvements to the thrust director assembly of the present invention will be apparent to those skilled in the art. Accordingly, no limitation on the invention is intended by way of the foregoing description and accompanying drawings, except as set forth in the appended claims.

What is claimed is:

1. A thrust director unit for a marine vessel, comprising:

housing means for mounting at one side of a hull of a marine vessel and defining an open flow passage therethrough for passage of a water flow between an inlet and an outlet, said outlet having a diverging cross sectional shape defined by diverging fore and aft walls interconnected by generally parallel top and bottom walls;

deflector vane means mounted within said outlet and comprising at least two deflector vanes rotatably supported between said top and bottom walls and movable therein between a sideward thrust position for discharging the water flow in a direction generally normal to a centerline of the marine vessel and at least one alternative thrust position for discharging the water flow in an angular direction relative to the centerline of the marine vessel;

said deflector vane means cooperating with said top and bottom walls of said housing means to define a substantially nondiverging discharge flow path and to isolate said fore an aft walls from the water flow when said deflector vane means is in said sideward thrust position; and actuator means for moving said deflector vane means between said sideward and alternative thrust positions.

2. The thrust director unit of claim 1 wherein said at least one alternative thrust position comprises a forward thrust position for discharging the water flow angularly rearwardly relative to the centerline of the marine vessel.

3. The thrust director unit of claim 2 wherein said deflector vane means cooperates with said housing means to define a substantially nondiverging discharge flow path when said deflector vane means is in said forward thrust position.

4. The thrust director unit of claim 1 wherein said at least one alternative thrust position comprises a rearward thrust position for discharging the water flow angularly forwardly relative to the centerline of the marine vessel.

5. The thrust director unit of claim 4 wherein said deflector vane means cooperates with said housing means to define a substantially nondiverging discharge flow path when said deflector vane means is in said rearward thrust position.

6. The thrust director unit of claim 1 wherein said at least one alternative thrust position comprises a forward thrust position for discharging the water flow angularly rearwardly relative to the centerline of the marine vessel, and a rearward thrust position for discharging the water flow angularly forwardly relative to the centerline of the marine vessel, said deflector vane means cooperating with said housing means in each of said forward and rearward thrust positions to define a substantially nondiverging discharge flow path.

7. The thrust director unit of claim 1 wherein said deflector vane means comprises at least two parallel deflector vanes, said actuator means rotatably moving said deflector vanes together within said outlet.

8. The thrust director unit of claim 7 wherein each of said deflector vanes comprises a set of at least two parallel vane blades.

9. The thrust director unit of claim 1 wherein said at least one alternative thrust position comprises a forward thrust position wherein said deflector vanes cooperate with said top and bottom and aft walls to define the discharge flow path to discharge the water angularly rearwardly relative to the centerline of the marine vessel, and a rearward thrust position wherein said deflector vanes cooperate with said top and bottom and fore walls to define the discharge flow path to discharge the water angularly forwardly relative to the centerline of the marine vessel, said fore wall being isolated from the water flow when said deflector vanes are in the forward thrust position, and said aft wall being isolated from the water flow when said deflector vanes are in the rearward thrust position.

10. The thrust director unit of claim 9 wherein said deflector vanes are oriented generally in parallel with said aft wall when said deflector vanes are in the forward thrust position, and further wherein said deflector vanes are oriented generally in parallel with said fore wall when said deflector vanes are in the rearward thrust position.

11. A thrust director unit for a marine vessel, comprising:

a nozzle housing for mounting at one side of a hull of a marine vessel and defining an open flow passage therethrough for passage of a water flow between an inlet and an outlet, said outlet being defined by diverging fore and aft walls interconnected by generally parallel top and bottom walls;

at least two deflector vanes mounted within said outlet to extend generally in parallel between said top and bottom walls, said deflector vanes being movable to a first position for discharging the water flow in a direction generally normal to the vessel hull, a second position for discharging the water flow in a direction angularly rearwardly relative to the vessel hull, and a third position for discharging the water flow in a direction angularly forwardly relative to the vessel hull;

said deflector vanes in said first position cooperating with said top and bottom walls to define a substantially nondiverging discharge water flow path substantially isolated from said fore and aft walls: and actuator means for selectively positioning said deflector vanes in said first, second and third positions.

12. The thrust director unit of claim 11 wherein said deflector vanes cooperate with said outlet walls in each of said second and third positions to define a substantially nondiverging water discharge flow path.

13. The thrust director unit of claim 12 wherein said deflector vanes are oriented generally in parallel with said aft wall in said second position, and generally in parallel with said fore wall in said third position.

14. The thrust director unit of claim 11 wherein one of said deflector vanes is positioned generally in abutting relation to an upstream end of said fore wall when said deflector vanes are in said second position to substantially isolate the water flow from said fore wall, and further wherein another of said deflector vanes is positioned generally in abutting relation to an upstream end of said aft wall when said deflector vanes are in the third position to substantially isolate the water flow from said aft wall.

15. The thrust director unit of claim 11 wherein at least two of said deflector vanes are positioned with upstream edges thereof respectively in abutting relation to upstream ends of said fore and aft walls when said deflector vanes are in said first position to substantially isolate the water flow from said fore and aft wall.

* * * * *